US006712158B2

(12) United States Patent
Moore

(10) Patent No.: US 6,712,158 B2
(45) Date of Patent: Mar. 30, 2004

(54) APPARATUS AND METHOD FOR CORING AND/OR DRILLING

(75) Inventor: Terence Alexander Moore, Near Montrose (GB)

(73) Assignee: Corpro Systems Limited, Whitecairns (GB)

( * ) Notice: Subject to any disclaimer, the term of this patent is extended or adjusted under 35 U.S.C. 154(b) by 0 days.

(21) Appl. No.: 10/118,188

(22) Filed: Apr. 8, 2002

(65) Prior Publication Data

US 2002/0157867 A1 Oct. 31, 2002

(30) Foreign Application Priority Data

Apr. 6, 2001 (GB) ..... 0108650

(51) Int. Cl.[7] ..... E21B 25/00
(52) U.S. Cl. ..... 175/20; 175/58
(58) Field of Search ..... 175/20, 58, 80, 175/81, 210, 45, 61

(56) References Cited

U.S. PATENT DOCUMENTS 4,354,558 A 10/1982 Jageler et al.
4,629,011 A * 12/1986 Reinhardt ..... 175/58
5,163,522 A * 11/1992 Eaton et al. ..... 175/58
5,311,954 A 5/1994 Quintana
5,456,312 A * 10/1995 Lynde et al. ..... 166/55.6
6,208,586 B1 * 3/2001 Rorden et al. ..... 367/35

FOREIGN PATENT DOCUMENTS

| | | |
|---|---|---|
| EP | 0 514 657 | 11/1992 |
| GB | 2305 953 A | 4/1997 |
| GB | 2352462 | 1/2001 |
| WO | WO 98/59146 | 12/1998 |

* cited by examiner

*Primary Examiner*—Frank Tsay
(74) *Attorney, Agent, or Firm*—Drinker Biddle & Reath LLP

(57) ABSTRACT

An apparatus and method for creating a hole in a subsurface formation is disclosed. The apparatus includes an inner assembly, which may include a coring barrel, a piston cylinder and a piston rod member, is connected to an elongate member such as a wireline. The inner assembly may include a member such as a packer capable of engaging one of an outer assembly and the borehole. Furthermore, the coring barrel may have a cutting member for creating the hole in the subsurface formation.

18 Claims, 4 Drawing Sheets

APPARATUS AND METHOD FOR CORING AND/OR DRILLING

FIELD OF THE INVENTION

This invention relates to a method and apparatus for selective coring or drilling, with particular application to recovering core samples from potential water, oil or gas reservoirs.

BACKGROUND OF THE INVENTION

Extracting core samples from downhole wells is an important aspect of the drilling process to provide geological and geophysical data to establish reservoir models.

Conventionally, core samples of a borehole are recovered from the bottom of a borehole during the drilling phase by means of a bit attached to the lower end of a core barrel which is further attached to the lower end of the drill string.

Sidewall cores may also be recovered during or after the logging phase, and a known method for obtaining side wall cores is described in our UK Patent No 2305953B. The conventional method of recovering borehole core samples typically produces long undisturbed samples which are preferred to the short, often highly fractured samples produced by the sidewall coring method, and it is desirable to increase the quality of the sidewall samples.

The accurate positioning of known coring apparatus is also difficult, frequently resulting in samples of limited value being recovered from geological zones of little interest.

Moreover, the equipment currently available to remove sidewall core samples tends to be somewhat cumbersome and expensive.

A further limitation of the prior art is the method of piercing the well bore lining to allow ingress of production fluids. Wells are conventionally lined with a section of metal tubing which is perforated to allow fluid to enter into the borehole.

These perforations are normally formed in a violent manner by setting off an explosive charge to fire projectile(s) through liner or by the explosive charge itself being designed to blast through the material. The lining is thereby ruptured and perforations are thus formed. However, such a method results in compression of the rock formation surrounding the perforation, reducing its pore size and creating a local barrier to fluid flows around, and significantly, into the borehole. The lining rupture caused by the explosive charge is also relatively uncontrolled and creates a random shape which is not streamlined and requires higher fluid energy to negotiate the perforation.

SUMMARY OF THE INVENTION

According to a first aspect of the present invention there is provided apparatus for creating a hole in a subsurface formation. The apparatus includes an inner assembly adapted for connection to an elongate member. The inner assembly is adapted to be raised and lowered within a borehole. The inner assembly includes a member capable of engaging either an outer assembly or the borehole.

According to a second aspect of the invention there is provided a method for creating a hole in a subsurface formation. The method comprises the steps of:

connecting an inner assembly to an elongate member, said inner assembly including a member capable of engaging either of an outer assembly or a borehole;

lowering the inner assembly within the borehole;

engaging the member with either of the outer assembly or the borehole to resist substantially vertical movement of at least a portion of the inner assembly with respect to at least one of the outer assembly or the borehole; and;

driving a cutting member into said subsurface formation to create a hole.

Preferably, the method is performed using the apparatus according to the first aspect of the invention.

The subsurface formation may be a casing, liner or subterranean formation.

Preferably, the method further comprises drilling a hole in a casing of a borehole, typically prior to drilling a hole in the subterranean formation.

The cutting member may be a drill bit. Preferably, the drill bit engages the lining of the borehole at a point proximate to the producing zones. Alternately or in addition, the drill bit preferably engages the borehole and punctures a hole therein.

In one embodiment the inner assembly also comprises a coring barrel.

A rotation resistance mechanism is preferably further provided to prevent rotation of at least a portion of the inner assembly with respect to at least one of the outer assembly or borehole.

Preferably, the member capable of engaging either the outer assembly or the borehole is an expandable member.

Preferably the outer assembly is incorporated into a tubular string comprising a side exit mandrel. Preferably the outer assembly is secured in said borehole before the inner apparatus is lowered therein. Typically, the tubular string is a drill string.

Preferably the expandable member engages the outer assembly. Preferably the expandable member is an inflatable member. Typically the expandable member is formed from rubber and metal and preferably has a high friction coefficient.

Preferably the inner assembly comprises a piston cylinder and preferably a piston rod member. Preferably the piston rod member extends through the piston cylinder, then typically through a rotation resistance mechanism and may connect to spacers below the rotation resistance mechanism. The coring barrel is preferably connected to the lower (opposite) end of the spacers if used or the rotation resistance mechanism if no spacers are used. Typically a drill bit is connected to the coring barrel to engage the geological formation.

Preferably, the rotation resistance mechanism comprises a locking mechanism which locks the piston rod member in a rotational direction with respect to the piston cylinder.

Preferably the elongate member is attached to a wireline head. Preferably the wireline head comprises a sacrificial weak link between the elongate member and the wireline head. Preferably the elongate member comprises electrical conductors and cable. Preferably the electrical conductors transfer communication and/or power from the surface of the borehole to the wireline head, or from the wireline head to the surface.

Preferably the wireline head is attached to a housing. Preferably the housing comprises a valve block, a hydraulic pump, power pack and fluid reservoir. Preferably the housing is also attached to the piston rod member.

Preferably the power pack comprises an electric motor, most preferably a low amperage electric motor. Preferably the electric motor is connected to electrical conductors of the elongate member. Preferably the housing also has an electronics carrier which is also attached to electrical conductors of the elongate member. Typically, the elongate member is a wireline.

Preferably the motor is activated from the surface, through the electrical conductors, to drive the hydraulic pump to transfer fluid from the reservoir into the piston cylinder.

Preferably the cylinder and inflatable member are connected by two fluid flow control means which may be valves. Typically, one valve permits fluids to transfer from the cylinder to the inflatable member and the second valve permits fluids to travel in the opposite direction, that is from the inflatable member to the cylinder. Typically either valve may be closed to resist transfer of fluids. Optionally the valves may be opened by actuation thereof, or alternatively when a specified fluid pressure is attained.

Preferably the main hub part of the piston cylinder is separated into two portions, typically by a piston attached to the piston rod assembly.

Preferably fluids can be injected or rejected from each portion of the main hub part of the piston cylinder. Preferably a first hydraulic line connects to the first, upper, portion of the main hub part of the piston cylinder and a second hydraulic line connects to the second, lower, portion of the main hub part of the piston cylinder. Typically each hydraulic line connects to the hydraulic pump and fluid reservoir. Typically fluid flow control means are provided to control the fluid travelling in the hydraulic lines between the reservoir/pump and each portion of the main hub part of the piston cylinder. Preferably the rate and direction of the fluid may be controlled by the fluid control means. Preferably the fluid control means are valves. Preferably there are four valves.

Preferably the first valve is provided on the first hydraulic line. Preferably the first valve is a two way valve, that is it may be set to allow fluid to travel from the reservoir to the cylinder or in the opposite direction, from the cylinder to the reservoir.

Preferably the second hydraulic line connects to the reservoir and pump via the other valves which are connected in parallel. Typically the second valve may transfer fluid from the reservoir to the lower portion of the cylinder. Typically the third and fourth valves allow fluid transfer from the lower portion of the cylinder to the reservoir. Preferably the third valve can accurately regulate the amount of fluid passing therethrough. Typically, a further valve is provided in series with the third valve to resist the flow of fluid therethrough below a specified pressure.

Typically, each valve can be set to resist flow of fluids therethrough.

Preferably the inner assembly has drive means for rotating said core barrel about its longitudinal axis. Preferably the drive means comprises a hydraulic motor, most preferably a positive displacement drilling motor or mud motor.

Preferably the inner assembly comprises flow diverter means, and most preferably the expandable member functions as the flow diverter means.

Preferably a rod assembly comprises the housing containing the power pack which comprises the hydraulic pump, electrical motor, electronics carrier and reservoir; and typically the rod assembly further comprises the piston rod member, piston, spacers (if used), mud motor, coring barrel and drill bit.

Preferably a packer assembly comprises the piston cylinder, the rotation resistance mechanism and the member capable of engaging the borehole or outer assembly.

The inflatable member may be inflated by injecting pressurised hydraulic fluid therein which expands and engages the borehole or outer assembly.

Preferably the expandable member frictionally engages the borehole or outer assembly, insodoing providing a reaction force for said coring barrel to engage an oil and gas reservoir below.

Preferably, fluid is injected into the piston cylinder of the inner assembly to move the piston with respect to the upper portion of the piston cylinder, thereby moving the rod assembly with respect to the packer assembly. The rod assembly includes the coring barrel and is thereby pushed down towards the oil and gas reservoir below wherein the reactive force is typically provided by the expandable member engaging the outer assembly.

Preferably the inflatable member is then disengaged from the outer assembly by appropriate means e.g. deflation of the member.

Typically the rod assembly is held by the wireline, and the piston and the top of the piston cylinder are pushed together by injection of hydraulic fluids which enter the lower portion of the piston cylinder thereby moving the packer assembly downhole.

In this position the rod and packer assembly are typically in the start position with respect to each other; but lower (e.g. 5 ft) with respect to the borehole, than the position in which they started collecting the core sample.

The method may be repeated as many times as necessary to complete the core sample. Typically the length of the main hub part of the piston cylinder is 5 ft, but could suitably be longer or shorter. Typically the length of the core barrel is 25 ft, but could suitably be longer or shorter. Therefore the method will normally be repeated five times, although this may be varied depending on the cylinder size, core barrel size, length of core required or for other reasons.

To extract the inner assembly from the borehole, the expandable member may be disengaged and the inner assembly may be winched up to the surface. Alternatively where winching cannot retrieve the inner assembly, because, for example, the coring barrel is jammed in the geological formation, the method of coring may be adapted to remove the inner assembly from the borehole.

In such a case, the expandable member may engage the borehole or outer assembly. Hydraulic fluid is injected into the lower portion of the cylinder to push the piston and complete rod assembly in an upwards direction. Optionally, the winch may also be used to assist this operation.

Preferably, the expandable member then disengages the borehole and the inner assembly is held on the wireline. The rod and packer assembly may then be separated by injecting hydraulic fluid into the upper portion of the piston cylinder, causing the packer assembly to move in an upwards direction.

The rod assembly may then be raised by engaging the expandable member with the outer assembly and injecting pressurised fluid into the lower portion of the cylinder, forcing the piston and rod assembly in an upwards direction.

This process may be repeated as necessary until the inner assembly may be retrieved by winching alone.

BRIEF DESCRIPTION OF THE DRAWINGS

Embodiments of the apparatus and methods of the present invention are described, by way of example only, with reference to the accompanying drawings, in which.

DETAILED DESCRIPTION OF THE PREFERRED EMBODIMENTS

Figure 1:
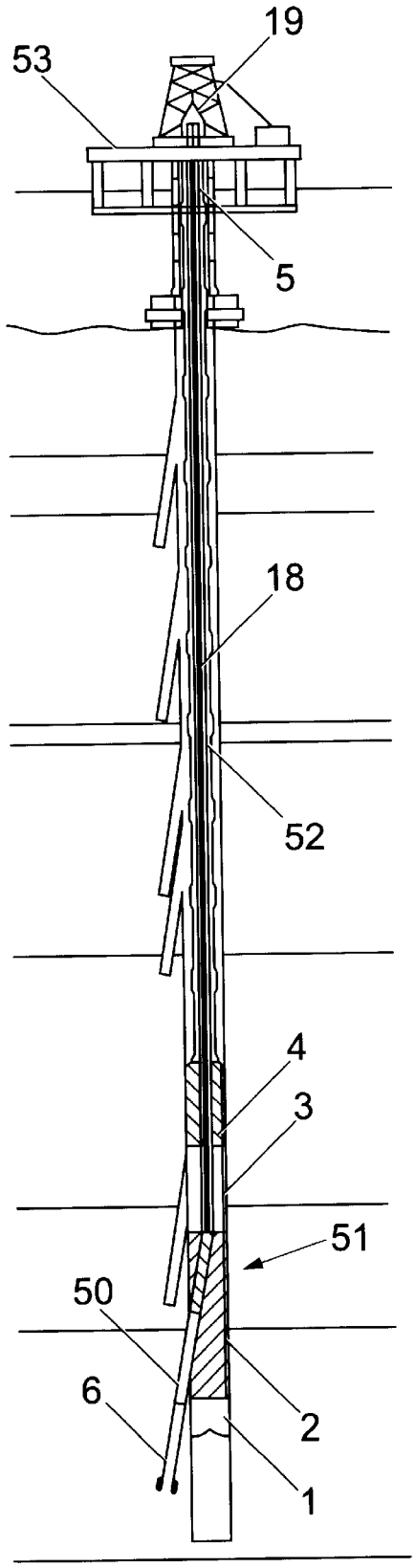
FIG. 1 is a simplified schematic view of an apparatus according to the present invention, showing the outer and inner assemblies.

The apparatus in accordance with the invention generally comprises an outer assembly 51 which is incorporated in a drill string 52. An inner assembly 50 includes a core barrel 6 and which is run into the outer assembly 51 by a wireline 18.

FIG. 1 shows an apparatus according to first and second embodiment of the invention being operated from a drilling platform 53; differences in the two embodiments will be subsequently detailed. The outer assembly comprises a side exit mandrel 2, positioned above a rock bit 1. The side exit mandrel 2, also known as a whipstock, consists of a steel tube approximately 7.6 m (25 ft) long with a hole of approx. 63.5 mm (2½") diameter starting centrally at the top, and exiting from one side at the lower end. The hole forms a long tapered side exit with an angle of approximately 1°. The lower end of the mandrel 2 is fitted with three centralising blades, preferably straight, with the side exit hole exiting along the top of one blade. Both ends of the barrel are threaded with standard API connections.

The side exit mandrel 2 is connected at its upper end to a drive sleeve 3, consisting of a tube approximately 9.1 m (30 ft) long, machined with an internal bore of approximately 63.5 mm (2½") diameter. The bore contains two opposing key slots of approximately 12.7 mm (½") width, travelling the length of the tube. Standard API connections are applied to both ends.

The upper end of the drive sleeve 3 is connected to a load control housing 4, consisting of a steel tube approximately 6.1 m (20 ft) long with a 76.2 mm (3") smooth bored hole through the centre and API connections top and bottom.

Figure 2:
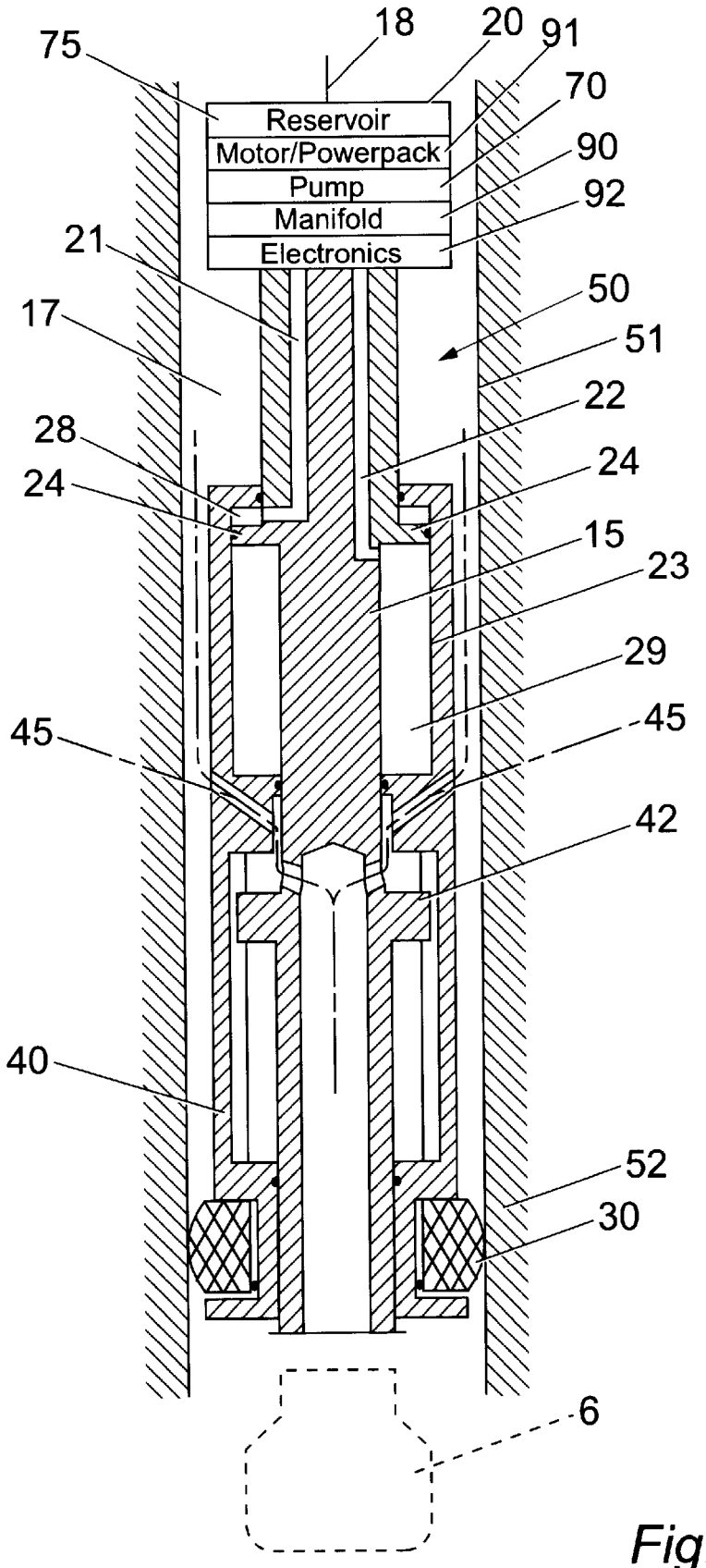
FIG. 2 is a sectional view of a first embodiment of the inner assembly, and a portion of the outer assembly, in accordance with the invention.

A first embodiment of the inner assembly 50 is shown in FIG. 2. The inner assembly 50 is coupled to, and suspended from, an electric wireline 18 which extends from a circulating head 19 of the drilling platform 53. The wireline 18 is a standard electric wireline 18 with the capability to raise and lower the inner assembly 50 with respect to the outer assembly 51, and provides electrical conductors, within itself, for power and communication purposes as will be subsequently discussed.

The wireline 18 is connected to the inner assembly via a conventional slimline wireline head (not shown), many of which are available from a variety of suppliers, one example of which is a Reeves™ wireline head. The wireline head typically has the capacity to connect the inner assembly 50 to seven electrical conductors provided within the wireline 18. The wireline head typically also provides a sacrificial weak link to the wireline 18.

Figure 3A:
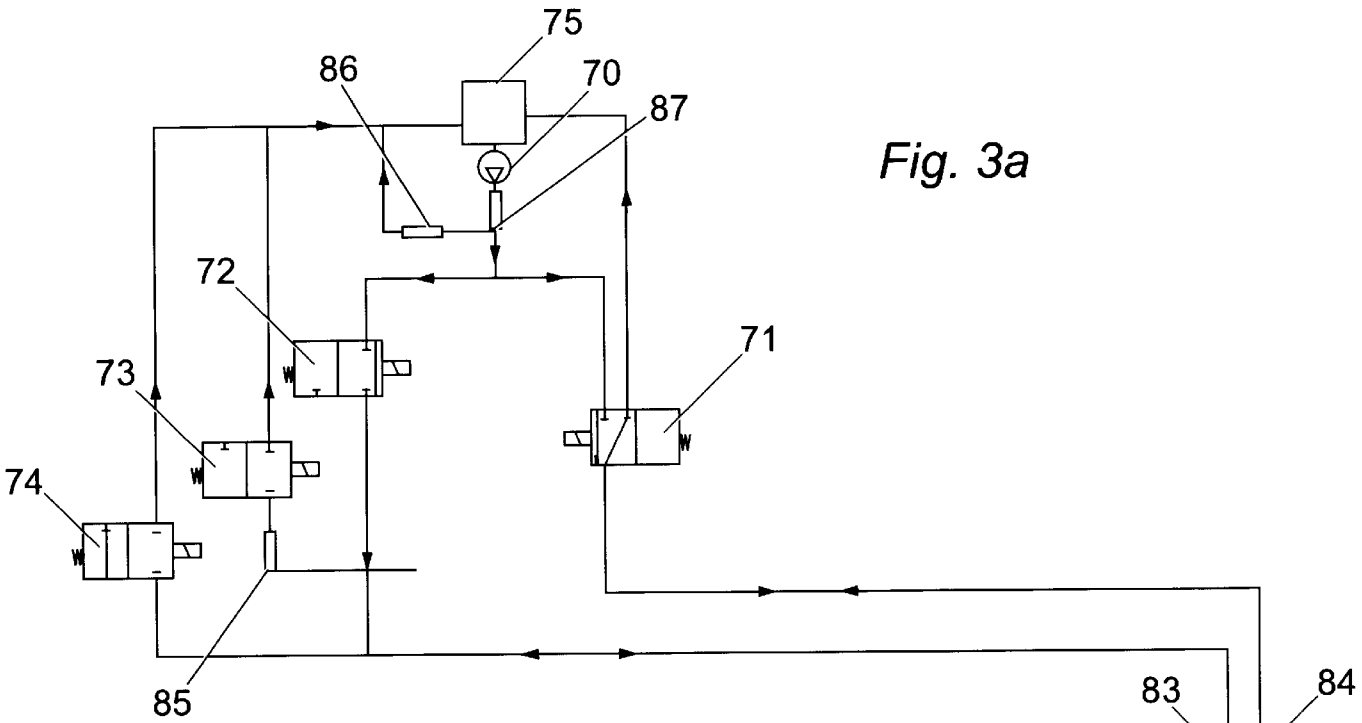
FIG. 3*a* is a schematic view of a hydraulic valve network, which forms part of the inner assembly according to the present invention.

The wireline head is in turn connected to a cylindrical rigid tubular housing 20 which contains a miniature single direction hydraulic pump 70, a valve block manifold 90 (as shown in schematic in FIG. 3*a*), a power pack 91 and electronics carrier 92 all described below.

The power pack 91 typically comprises a high voltage (400 v–500 v), low amperage electric motor, the rotational output of which is coupled directly to the hydraulic pump 70. The pump 70 is capable of producing a small volume of typically 0.5–0.8 l/m at a pressure of 3000 psi and will be capable of starting under load. Both the electric motor and hydraulic pump 70 are immersed in a flexible reservoir or tank 75 that is in turn located inside the rigid tubular housing 20. A cable head (not shown) is attached to the top of the housing 20 and electric wires leading from the wireline head protrude through and into the reservoir 75; five or six of these electric wires are attached to the electric motor and the others continue down, protrude through and out of the reservoir 75, and connect to the electronics carrier 92. The power pack 91 attaches directly to the valve block 90 utilising a series of "O" rings (not shown) to provide pressure integrity.

The valve block 90 typically comprises up to 4 individual electrically operated solenoid valves into the side of the housing 20, aligned horizontally. The valves are retained on the housing 20 with cap nuts (not shown) and oriented so that their working exits correspond directly with a specially drilled port system that has been manufactured through the valve block. The valve block 90 also comprises a drilled conduit which provides a passageway for the electrical conductors to pass into the electronics carrier located below the valve block 90.

Additionally, various relief and check valves are provided within the valve block, and are designed to direct the hydraulic fluid through an electronics carrier to a cylinder 23 and packer 30. An oriented non-rotating coupling connects the valve block to the carrier with suitably positioned "O" rings providing pressure integrity.

The electronics carrier 92 has a drilled bore (not shown) which retains an electronics board (not shown) and an electric conduit to provide the electrical connection to a linear transducer (not shown). The linear transducer is a standard component which senses the position of the piston 24 in the cylinder 23. The linear transducer is provided within a piston rod member 15 and senses the existence of a magnet (not shown) in a top cylinder gland 89 (not shown in FIG. 2 but shown in FIG. 3*b*.) The electronic board is a standard board designed to provide digitised communication via a restricted number of electrical conductors between the down hole valves/transducer and the surface 59. The carrier 92 also has drilled ports which allow the hydraulic fluid to flow into the cylinder 23 and packer 30 below.

A control panel unit (not shown) is provided at the surface to manipulate the apparatus. The control unit includes four control switches (not shown) which are linked to the valves 71–74 via wireline conductors (not shown) in the wireline 18. A progressive switch (not shown) controls the electric power to the motor. Gauges (not shown) are provided on the control unit, one for monitoring the amperage supplied to the electric motor and one to monitor the position of the piston 24 with respect to the cylinder 23, as indicated by the linear transducer.

The housing 20 is attached to the rod 15 which carries an upper piston 24. Hydraulic lines 21, 22 shown in FIG. 2 connect the hydraulic pump 70 to the inside of a slimline piston rod member hydraulic cylinder 23. The cylinder 23 defines a chamber 28, 29 therein which is split into two portions 28, 29 by the piston 24.

The packer 30 is a standard third party supplied packer, typically used without an exterior rubber cover. It is typically manufactured from a combination of metal and rubber and has a high friction coefficient. A weight gauge (not shown) is provided below the packer 30.

As shown in FIG. 2, the piston rod member 15 has a key 42 in the region above the packer 30. In use, the key 42 engages slots 43 milled into the inner circumference of a torque tube 40 and act to prevent rotation of the piston rod member 15 with respect to the torque tube 40 about its longitudinal axis. The rod 15 extends through a seal in the bottom of the torque tube 40. The torque tube 40 may be integral with the cylinder 23, or could be a separate component secured to the cylinder 23. In alternative, and preferred embodiments there are 4 keys welded onto the inner circumference of the torque tube 40 and four corresponding slots milled into the outer circumference of the rod 15.

Spacer rods (not shown) may be attached to the bottom of the rod 15 shown in FIG. 2 and have a coring or drilling assembly, as the case may be, attached to their opposite end. The spacers allow the inner assembly to extend below the side exit mandrel 2.

The coring/drilling assembly is powered by a conventional positive displacement mud motor (not shown). Mud is directed into inflow ports 45 via the lower portion of the inner bore of the rod 15 and the inner bore of the spacers to the mud motor. Typically a dump sub (not shown) is provided to control the mud flowing through the mud motor, excess mud being disposed into the annulus 17 between the inner 50 and outer 51 assemblies.

The core barrel 6 can be a mining style barrel with bearing suspended inner tubes that are supplied in multiples of 5 of 10 ft (or other multiple to correspond with the piston's stroke). The inner tubes are typically standard steel versions suitable for recovering core of 1.4" diameter. The outer barrels are typically thin wall models that enable higher than average flow rates and offer little resistance to the high bending loads introduced when passing over the side exit mandrel 2.

To operate the apparatus, the side exit mandrel 2 is attached directly to the bottom of the heavy weight drill pipe used when drilling the original well. The outer assembly 51 and drill string 52 is lowered into the well to the required depth and landed into the slips.

The inner assembly 50 is assembled on the surface and run down to the required level on the wireline 18. The packer 30 is then inflated, by activating the electric motor to operate the hydraulic pump 70 to inflate the packer 30.

The packer 30 abuts against the outer assembly 51 to form a frictional connection therebetween and resist vertical movement of the packer 30 with respect to the outer assembly 51.

The connection between the packer 30 and the outer assembly 51 can be checked by lowering the wireline 18 and monitoring the weight of the inner assembly 50—a reduced weight confirms that the packer 30 is supporting the inner assembly 50.

Typically, 5 ft of wireline 18 is lowered into the drill string 52 before the circulating head 19 is closed. Alternatively, where the stroke of the piston 24 is larger or smaller than 5 ft, the appropriate amount of wireline 18 is inserted.

To perform the drilling/coring operation, the mud pumps are activated by energising the electric motor from the surface via the electrical conductors, the pressure of hydraulic fluid and weight of the inner assembly being continually monitored.

When operating the piston action of the inner assembly 50, the piston rod member 15 and cylinder 23 move with respect to each other, as will be described below. When the piston rod member 15 and cylinder 23 move, the other components in the inner assembly 50 either move along with the piston rod member 15 or along with the packer 30. The housing 20 containing the electronics carrier, hydraulic pump, valve block, tank and power pack; the spacers (if used), and the piston 24 move with the piston rod member 15 and are defined as the "rod assembly". The wireline 18 is attached to the rod assembly as previously described.

The cylinder 23 and the torque tube 40 move with the packer 30 and are defined as the "packer assembly".

As previously described the packer 30 is inflated and hydraulic fluid is then directed into the area 28 by an operator controlling the valves in the valve block 90 from the surface via the electric cable 18. The hydraulic fluid pushes the piston 24 down—reactive force being provided by the packer 30 engaging the outer assembly 51—which in turn moves the attached rod assembly (which includes the drill bit) down to engage and drill or core the geological formation below.

Once the rod assembly has completed its stroke, and the required drilling, cutting or coring has been completed, the packer 30 is then deflated and disengaged from the outer assembly 51. Hydraulic fluid is directed into the lower portion of the cylinder 29 and the piston 24 and the top of the cylinder 23 are pushed together. This results in the piston 24 and rod assembly remaining static while the packer assembly moves down towards the rod assembly until the piston 24 abuts against the top of the cylinder 23.

The above described process may then be repeated to recover a further portion of rock formation into the core barrel 6.

The drill bit may be raised at any time. This is achieved by engaging the packer 30 with the outer assembly 50 as previously described. Hydraulic fluid is directed into the lower portion 29 of the cylinder 23 which forces the piston 24 upwards along with the piston rod member 15, spacers and drill bit.

Figure 3B:
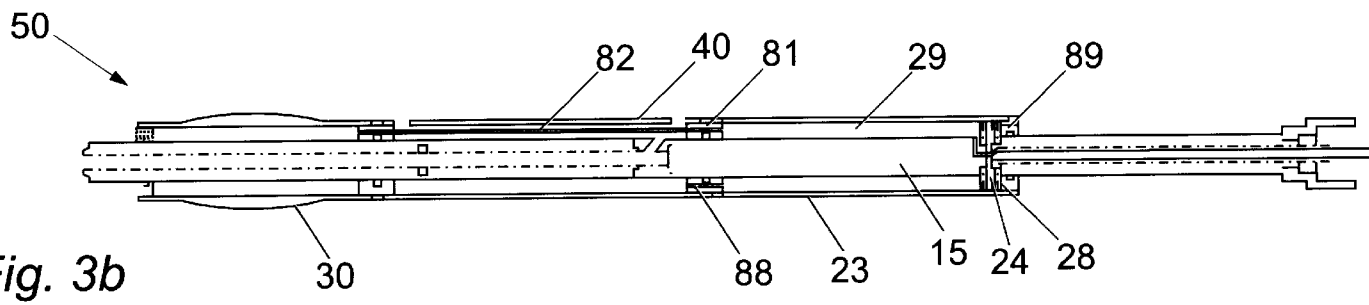
FIG. 3*b* is a sectional view of the inner assembly.

A second embodiment of packer assembly and rod assembly in accordance with the present invention is shown in FIG. 3*b*. The second embodiment shares many common features with the first embodiment, and where this is the case, common reference numerals have been used; where this is not the case, the differences are described below.

The second embodiment of the inner assembly 50 comprises a hydraulic cylinder 23, a torque tube 40 and a packer 30 all referred to as the "packer assembly". The inner assembly 50 further comprises a rod 15 and associated components, such as an electronics carrier, hydraulic pump, valve block (which houses the valves 71–74), tank and motor, spacers and a coring barrel (not shown) all previously described with respect to the first embodiment and referred to as the "rod assembly". The rod 15 extends through the cylinder 23 and has an attached piston 24 which divides the cylinder 23 into an upper 28 and lower 29 portion.

The two-way valve 71 is connected to the upper portion 28 of the cylinder 23 via hydraulic line 84. Valves 72, 73 and 74 are connected to the lower portion 29 of the cylinder 23 via the hydraulic line 83. An insert gland 88 seals the lower 29 portion of the cylinder 23 and the top cylinder gland 89 seals the upper 28 portion of the cylinder 23. A pressure release valve 81, in the insert gland 88, connects to a hydraulic line 82 to transfer hydraulic fluid from the lower 29 portion of the cylinder 23 to the packer 30.

In the start position, the piston 24 is positioned at the top of the cylinder 23 (as shown in FIG. 3*b*) with all valves 71–74 closed. To operate the inner assembly 50, valve 72 is opened to allow hydraulic fluid to travel through the hydraulic line 83 into the lower portion 29 of the cylinder 23. The pressure in the lower portion 29 of the cylinder 23 increases until it exceeds that of the pressure release valve 81 causing the hydraulic fluid to continue through the hydraulic line 82 and into the packer 30. Continued injection of hydraulic fluid into the packer 30 causes the packer to inflate and engage the outer assembly or borehole (not shown in FIG. 3*b*) as appropriate. A pressure release valve 85 is provided between the valve 73 and the inner assembly 50 to ensure that the pressure in the packer 30 does not fall below the required level to maintain it inflated and engaged with the outer assembly or borehole, as the case may be.

The operation continues as described for the previous embodiment; wireline 18 is lowered into the drill string 52 and the circulating head 19 is closed and the mud pumps are activated.

When the packer 30 is fully inflated, valve 72 is closed and valve 71 is opened, and hydraulic fluid is pumped into the upper portion 28 of the hydraulic cylinder 23 via the hydraulic line 84. Valve 73 is opened so that only the pressure release valve 85 prevents the hydraulic fluid in the lower portion 29 of the cylinder 23 draining through the hydraulic line 83 back to the tank 75. This ensures that a minimum level of pressure is maintained in the lower portion 29 of the cylinder 23 and in the packer 30. Once the pressure in the lower portion 29 of the cylinder 23 exceeds that of the pressure release valve 85 due to the continued injection of the hydraulic fluid into the upper portion 28 of the cylinder 23, the fluid in the lower portion 29 drains through the hydraulic line 83, pressure release valve 85 and valve 73 back to the tank 75.

Piston 24, core barrel and all other components included in the rod assembly are thus forced downwards towards a geological formation below whereas vertical movement of the cylinder 23 and other components of the packer assembly are resisted by the engagement of the packer 30 with the outer assembly or borehole as the case may be. An increase in pressure of drilling mud within the drill pipe 52 (i.e. the standpipe pressure) will signify that the motor is encountering resistance, i.e. that the bit has started cutting. The progress of the bit into the reservoir is controlled by opening valve 73 to its maximum extent without stalling the motor 70.

At the end of its stroke (normally 5 ft), the piston 24 abuts against the insert gland 88 and so further downward movement of the piston and therefore the rod assembly is resisted. After the full stroke of the piston 25 has been completed, valve 73 is closed and the hydraulic pump 70 shut down. The mud pumps are stopped and the standpipe pressure vented off. The circulating head 19 is released and tension is applied to the wireline 18. At this point, the core barrel, may contain a core sample, the length of the core sample corresponding to that of the piston stroke. Valve 74 is opened to drain the hydraulic fluid from the packer 30 through line 83 back to the tank 75, insodoing deflating and disengaging the packer 30 from the outer assembly.

The packer assembly is then moved towards the geological formation below by closing valve 74 and opening valve 72. Hydraulic fluid is pumped through hydraulic line 83 into the lower portion 29 of the hydraulic cylinder 23 forcing the rod and packer assemblies apart. As the rod assembly comprises components which weigh approximately three times that of the packer assembly, the latter will be forced down towards the geological formation below until the piston 24 abuts against the top cylinder gland 89 of the cylinder 23.

The packer 30 can then be inflated as previously described and an additional section of core cut. The process may continue until the core barrel is full or has removed the required amount of core. Thus embodiments of the invention allow core samples e.g. 25 ft long to be recovered by apparatus comprising a single piston stroke of 5 ft; the limitation on the size of the core sample depends only the length of the core barrel 6 and not on the length of the piston stroke.

The bit may be retrieved from the geological formation when it is jammed therein or when the drilling or coring is complete and the inner assembly 50 is to be removed to the surface, by applying an upwardly directed force.

To apply the necessary upward force, valve 71 is placed in the return position and valves 72, 73 and 74 are all closed, leaving the packer 30 inflated. The hydraulic pump 70 is switched on. When the coring or drilling is complete the piston 24 will normally be abutting against the lower end 26*b* of the cylinder 26.

Opening valve 72 will allow hydraulic fluid to enter the lower portion 29 of the cylinder 26, which acts to push the piston 24 and the whole of the rod assembly in an upwards direction, insodoing removing the bit from the geological formation.

Hydraulic fluid in the upper portion 28 of the cylinder 26 is drained through valve 71 back into the tank 75. If necessary, extra upward force may be exerted on the rod assembly by loosening the circulating head 19 at the surface and pulling the wireline 18 with any suitable winch (not shown).

The piston 24 is moved to the upper end of the cylinder 26 and the drill bit or core barrel 6, being attached to the piston rod member 15 and piston 24 via spacer rods etc is removed from the geological formation by the length of the piston stroke (normally 5 ft).

Thus certain embodiments of the invention benefit from the ability to conveniently release the bit from the rock formation by applying an upward force via the hydraulic valve network 70–76.

Drilling or coring may optionally be continued as previously described.

To remove the inner assembly 50 to the surface, the hydraulic pump 70 is switched off and the load is placed on the wireline 18. The packer 30 is deflated by opening valve 74 with valves 72 and 73 closed and valve 71 in the return position. The inner assembly 50 may then be winched to the surface.

In the event that more effort is required to retrieve the inner assembly 50 to the surface, the packer assembly may be forced towards the surface by hydraulically activating the piston 24 in the cylinder 26; resulting in the rod assembly including the piston 24 remaining static and the packer assembly including the cylinder 26 and packer 30 rising towards the surface. The packer 30 can then be inflated to hold it in the higher height, and the rod assembly raised to the level of the packer assembly by action of the piston 24 in the cylinder 26 working in the opposite direction, with the packer 30 anchoring the packer assembly at the higher height.

To achieve this valve 74 is opened, the hydraulic pump is started and valve 71 is placed in the open position. Hydraulic fluid will enter the upper portion 28 of the cylinder 26 forcing the piston 24 and the cylinder 26 apart. Hydraulic fluid in the lower portion 29 of the cylinder 26 is drained through valve 74 to the tank 75. As the piston 24 is attached to the piston rod member 15 which is in turn attached to the wireline 18, the result of the hydraulic fluid entering the upper portion 29 of the cylinder 26 is to raise the packer assembly towards the surface.

When fully stroked (normally 5 ft) the piston 24 will be in its lower position, that is, abutting against the lower end of the cylinder 26.

The packer 30 is then inflated by opening valve 71 to pressure, closing valves 73 and 74 and opening valve 72 to inject hydraulic fluid into the lower portion 29 of the cylinder 26 which will in turn inflate the packer 30 as previously described. The piston 24 is held static throughout this operation by the pressure exerted into the upper portion 29 of the cylinder 26 through valve 71. When the packer 30 is inflated, valve 72 is closed and valve 71 is set in the return position.

The rod assembly may then be raised as described previously, that is by opening valve 72, allowing hydraulic fluid to enter into portion 29 of the cylinder 26 (fluid in portion 28 of cylinder 26 being drained through valve 71 to the tank 75) insodoing pushing the piston 24 towards the upper end of the cylinder 26.

This process may be repeated as necessary to move the inner assembly 50 up the outer assembly 51 until it is possible to remove it by winching in the wireline 18. When this is possible the hydraulic motor 70 is shut down, valves 72, 73 and 74 are closed and valve 71 is set to the return position. The circulating head 19 is pressured up to allow the wireline 18 to be retrieved without mud loss and the inner assembly 50 is pulled to the surface.

The apparatus may also be used to drill side-tracks from wells, and also perforations into wells, and in this scenario, a drill bit of up to 3" (normally 2.5") diameter would be used.

Figure 4:
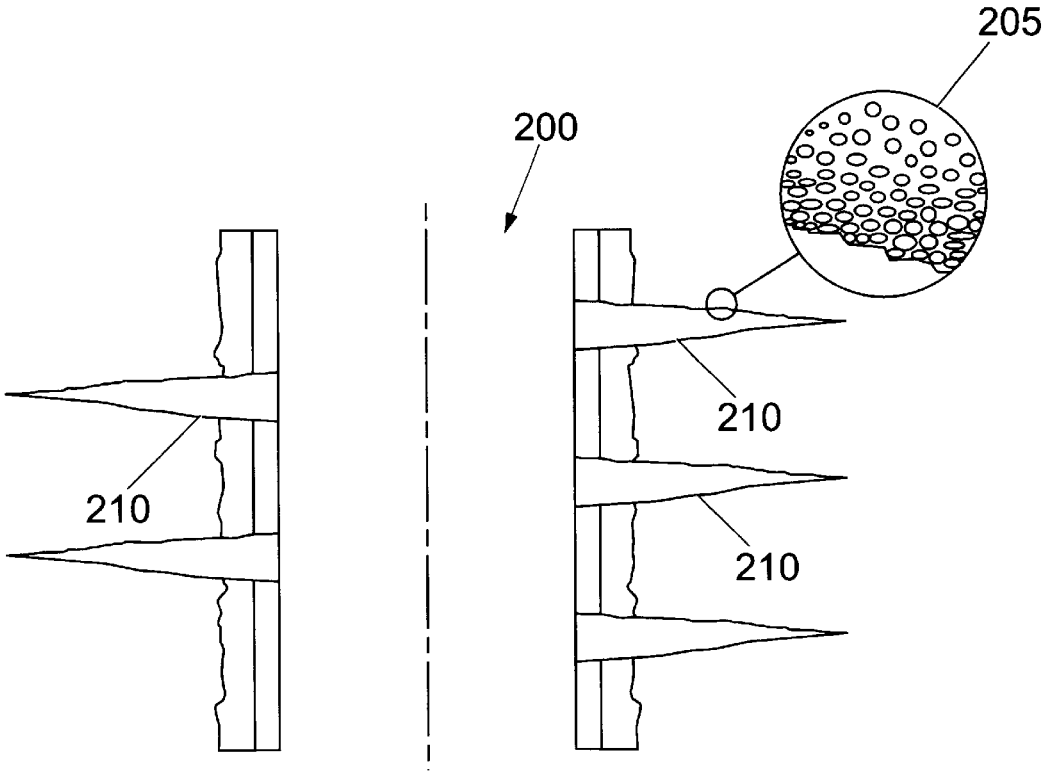
FIG. 4 is a schematic view of a prior art and conventional method of perforating tubing with explosive detonation; and, FIG. 5 is a schematic view of drilling a perforation in accordance with the present invention.
Figure 5:
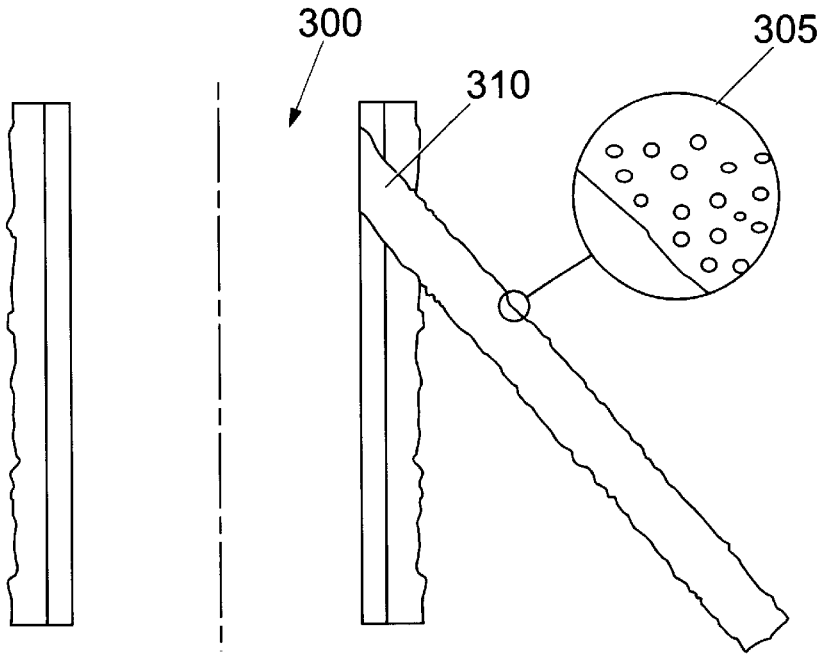

FIG. 5 shows a perforation 310 formed in a lined borehole 300. FIG. 4 shows the perforations 210 formed in a similar borehole 200 using apparatus and method common in the art, namely explosive detonation.

The density 305 of the rock formation around the perforation 310 in FIG. 5 is much less compared with the density 205 of the perforations in FIG. 4 utilising known technology. This scenario has the advantage over existing methods of perforating wells because the perforated area of the well is not compressed. Indeed, the perforated area may optionally be removed in an attached the core barrel, and thus increased production rates are experienced. A further advantage is the streamlined perforation formed in the borehole lining.

Changes and modifications may be made to the embodiments without departing from the scope of the invention.

What is claimed is:

1. Apparatus for creating a hole in a subsurface formation, the apparatus comprising:

an inner assembly adapted for connection to an elongate member wherein the inner assembly is adapted to be raised and lowered within a borehole;

the inner assembly including a member capable of engaging one of an outer assembly and the borehole;

wherein the inner assembly also comprises a coring barrel.

2. Apparatus according to claim 1, further comprising a cutting member for creating the hole in said subsurface formation.

3. Apparatus according to claim 2, wherein the member capable of engaging one of the outer assembly and the borehole frictionally engages either the borehole or outer assembly, thereby providing a reaction force for said coring barrel to engage an oil and gas reservoir.

4. Apparatus according to claim 1, wherein the subsurface formation is selected from a group consisting of a casing, a liner and a subterranean formation.

5. Apparatus according to claim 1, wherein the member capable of engaging one of the outer assembly and the borehole is an expandable member.

6. Apparatus according to claim 1, wherein the expandable member comprises a packer mechanism.

7. Apparatus according to claim 1, wherein the elongate member comprises at least one electrical conductor which permits transfer of communication and/or power from the surface of the borehole to the apparatus located within the borehole.

8. A method for creating a hole in a subsurface formation, comprising the steps of:

providing an apparatus including an inner assembly adapted for connection to an elongate member wherein the inner assembly is adapted to be raised and lowered within a borehole;

the inner assembly including a member capable of engaging one of an outer assembly and the borehole and a cutting member for creating the hole in said subsurface formation;

wherein the cutting member is operated to drill a hole in a casing of a borehole, prior to drilling a hole in a subterranean formation.

9. Apparatus for creating a hole in a subsurface formation, the apparatus comprising:

an inner assembly adapted for connection to an elongate member wherein the inner assembly is adapted to be raised and lowered within a borehole;

the inner assembly including a member capable of engaging one of an outer assembly and the borehole;

wherein a rotation resistance mechanism is further provided to prevent rotation of at least a portion of the inner assembly with respect to at least one of the outer assembly and the borehole.

10. Apparatus for creating a hole in a subsurface formation, the apparatus comprising:

an inner assembly adapted for connection to an elongate member wherein the inner assembly is adapted to be raised and lowered within a borehole;

the inner assembly including a member capable of engaging one of an outer assembly and the borehole;

wherein the inner assembly further comprises a piston cylinder and a piston rod member, wherein the piston rod member extends through the piston cylinder, and further extends through a rotation resistance mechanism.

11. Apparatus according to claim 10, wherein the apparatus comprises a rod assembly which includes a piston, the piston rod member and the cutting member.

12. Apparatus according to claim 11, wherein fluid is injected into the piston cylinder of the inner assembly to move the piston with respect to the piston cylinder, thereby moving the rod assembly with respect to the piston cylinder, the rotation resistance mechanism and the member capable of engaging one of the outer assembly and the borehole.

13. Apparatus according to claim 12, wherein the movement of the rod assembly includes movement of the coring barrel which is thereby pushed towards an oil and gas reservoir wherein a reactive force is provided by the member capable of engaging one of an outer assembly and the borehole.

14. A method for creating a hole in a subsurface formation, the method comprising the steps of:

lowering an inner assembly into a borehole;

engaging the inner assembly with either of an outer assembly or the borehole to resist substantially vertical movement of at least a portion of the inner assembly with respect to at least one of the outer assembly or the borehole; and, driving a cuffing member into said subsurface formation to create a hole;

wherein the said subsurface formation is recovered into a core barrel.

15. A method according to claim 14, wherein the inner assembly member engages with either of the outer assembly or the borehole by operation of an expandable member.

16. A method according to claim 15, further comprising the step of disengaging the expandable member from said engagement.

17. A method according to claim 16, wherein the inner assembly is extracted from the borehole by removing the engagement of the expandable member, and winching the inner assembly up to the surface.

18. A method for recovering a sample from a subsurface formation, the method comprising the steps of:

lowering an inner assembly comprising an expandable member into a borehole;

engaging the expandable member with either of an outer assembly or the borehole to resist substantially vertical movement of at least a portion of the inner assembly with respect to at least one of the outer assembly or the borehole; and, driving a cutting member into said subsurface formation to create a hole;

recovering a portion of the subsurface formation into a core barrel;

disengaging the expandable member from said engagement;

moving the inner assembly with respect to at least one of the outer assembly or borehole;

engaging the expandable member with either of the outer assembly or the borehole to resist substantially vertical movement of at least a portion of the inner assembly with respect to at least one of the outer assembly or the borehole;

driving the cutting member further into said subsurface formation; and recovering a further portion of the subsurface formation into the core barrel.

* * * * *